US006946591B2

(12) United States Patent
Lee

(10) Patent No.: US 6,946,591 B2
(45) Date of Patent: Sep. 20, 2005

(54) SAFETY DEVICE USED ON PIANOS TO PREVENT LID-SLAMMING

(76) Inventor: Jen-Feng Lee, 17800 Castleton St., Suite 383, City of Industry, CA (US) 91748

( * ) Notice: Subject to any disclaimer, the term of this patent is extended or adjusted under 35 U.S.C. 154(b) by 0 days.

(21) Appl. No.: 10/708,320

(22) Filed: Feb. 24, 2004

(65) Prior Publication Data

US 2005/0183563 A1 Aug. 25, 2005

(51) Int. Cl.[7] ..... G10C 3/02
(52) U.S. Cl. ..... 84/177
(58) Field of Search ..... 84/173–179, 183, 84/453; 372/333, 327, 328; 292/DIG. 28; 273/DIG. 25; 248/206.2, 206.3; 211/86.01, 211/94.01, 100

(56) References Cited

U.S. PATENT DOCUMENTS 3,042,958 A * 7/1962 Spears ..... 16/84
4,053,961 A * 10/1977 Wilson et al. ..... 16/84
5,175,386 A * 12/1992 Kuwahara ..... 84/179
5,920,019 A * 7/1999 Inoue ..... 84/179

* cited by examiner

*Primary Examiner*—Kimberly Lockett
(74) *Attorney, Agent, or Firm*—Jen-Feng Lee

(57) ABSTRACT

A safety device used on pianos to prevent the slamming of keyboard lid. Present invention uses a suction cup with a rod that can be folded down, so that it takes up very limited room, when it rod is down. When in use, if the piano keyboard lid is tilted towards the closing position, a rubber roller on top of the rod will contact the inner surface of the lid and stop the falling motion, preventing injuries to piano player's hand or fingers. The inner 90-degree angle of the lid will serve as a catch-well for the rubber roller to prop up the lid.

2 Claims, 2 Drawing Sheets

5
30
20
40
10
P
B
W
30
20

SAFETY DEVICE USED ON PIANOS TO PREVENT LID-SLAMMING

BACKGROUND OF INVENTION

The present invention relates generally to a safety device used on pianos to prevent injury caused by accidental slamming of the keyboard lid.

Present invention utilizes the gravity of the lid and the downward slamming momentum to press down on a suction cup, increasing the stability of the cup. With the use of a spring mechanism, the rod automatically erects every time the lid is opened, so that users need not remember to "set the device".

Present invention utilizes the platforms on both side of a piano keyboard layout and the lid structure to reduce the complexity of the safety device.

SUMMARY OF INVENTION

Present invention provides a simple and lost-cost alternative to the anti-slamming device products. Once the device is used on a piano, users need not put it away because it takes up very limited room. Unlike other anti slamming devices utilizing pneumatic or hydraulic means, present invention will not cause any cosmetic damage to the piano.

BRIEF DESCRIPTION OF DRAWINGS

The accompanying drawings, which are incorporated in and constitute a part of this specification, illustrate the preferred embodiment of the invention and together with the description, serve to explain the principles of the invention.

A brief description of the drawings is as follows.

DETAILED DESCRIPTION

Figure 1:
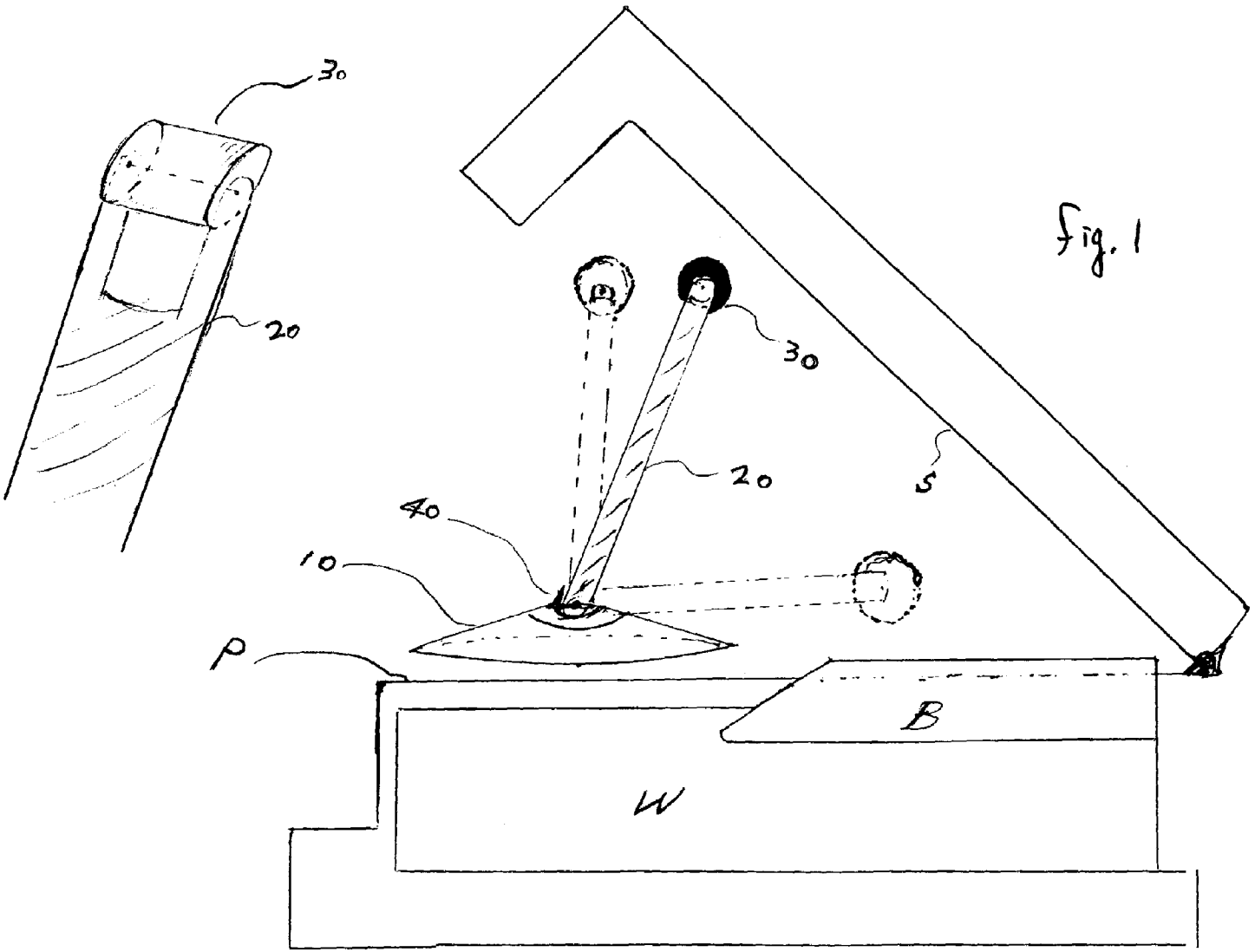
FIG. 1 shows the side view of present invention. P indicates the small platform area to the right or left of the keyboard on a piano. Depending on brand, the width of left platform is usually about 3 inches wide, the width of right platform is usually about 2 inches wide.

In FIG. 1, suction cup 10 is shown on top of a piano platform P. When in use, simply press suction cup 10 vertically down towards the platform P.

A rod 20 is connected to the top center of suction cup 10 by hinge means. On top end of rod 20, there is a rubber roller 30.

A stopper piece 40 is built to one side on the top center of suction cup 10, to control the angle the rod can be erected. Preferably the angle should be less than 90 degrees.

When the rod 20 is down, the lid is closed, the distance between lid's inner surface S to platform P is about half an inch. Proper size of the suction cup 10, rod 20 and rubber roller 30 can be made so that they can fit easily within the half an inch space.

Figure 2:
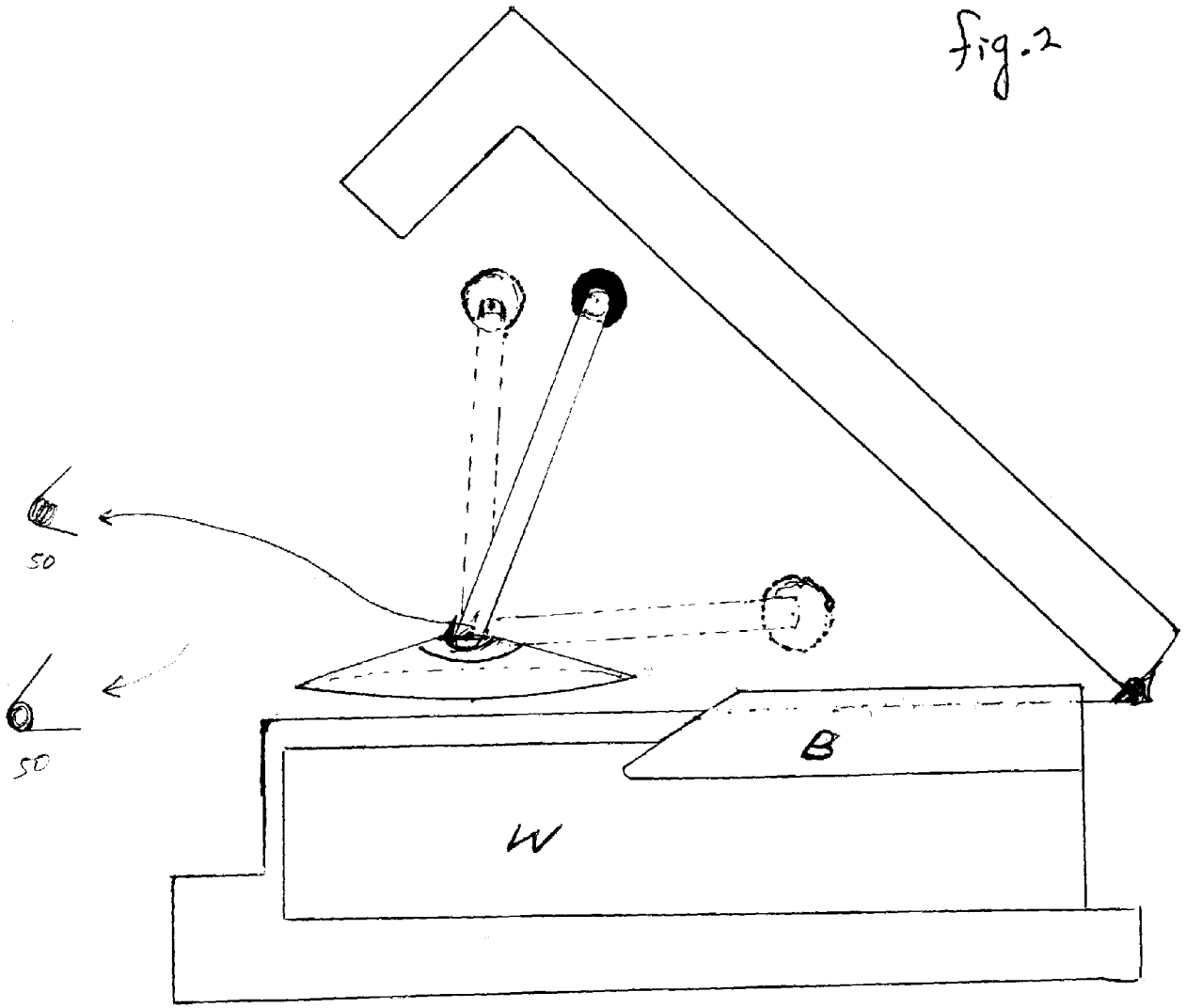
FIG. 2 shows the side view of present invention. A spring means is shown to automatically erect the rod whenever the keyboard lid is open.

In FIG. 2, a spring means 50 is added to the hinge means where rod 20 is connected to the suction cup 10. That way, instead of user having to remember getting the rod up (when playing piano) and then nudging it down (when ready to close the lid), the rod will automatically erected whenever the lid is open. When the user is ready to close the lid, simply nudge the rod 20 forward and down a bit, the rubber roller will glide down the surface S as the lid is gradually lowered down.

FIG. 2 show a coil spring 50 on the left; the top shows its perspective view, the bottom shows its side view.

In FIGS. 1 and 2, B and W show the position of black and white keys on the piano keyboard.

The inner 90-degree angle of the lid will serve as a catch-well for the rubber roller to prop up the lid.

What is claimed is:

1. A safety device in combination with a piano having a keyboard lid and a platform to prevent lid-slamming, comprising:

a. A suction cup releasably secured to said platform;

b. A rod having a first end pivotally connected to the top center of said suction cup and a second end having a rubber roller rotably affixed and engaging said keyboard lid; and, c. A stopper piece on the top center of said suction cup to control the erection angle of said rod.

2. The device of claim 1, wherein the first end of said rod further having a spring means to prop up said rod automatically whenever the keyboard lid is open.

* * * * *